US010368597B2

(12) United States Patent
Lashbrook

(10) Patent No.: US 10,368,597 B2
(45) Date of Patent: Aug. 6, 2019

(54) TIE FASTENER

(71) Applicant: Billy Lashbrook, Lago Vista, TX (US)

(72) Inventor: Billy Lashbrook, Lago Vista, TX (US)

( * ) Notice: Subject to any disclaimer, the term of this patent is extended or adjusted under 35 U.S.C. 154(b) by 131 days.

(21) Appl. No.: 15/589,911

(22) Filed: May 8, 2017

(65) Prior Publication Data

US 2018/0317580 A1 Nov. 8, 2018

(51) Int. Cl.
*A41D 25/02* (2006.01)

(52) U.S. Cl.
CPC ..... *A41D 25/022* (2013.01); *A41D 25/02* (2013.01); *Y10T 24/19* (2015.01); *Y10T 24/3938* (2015.01)

(58) Field of Classification Search
CPC ..... Y10T 24/3939; Y10T 24/3938; Y10T 24/394; Y10T 24/3953; Y10T 24/3936; Y10T 24/19; Y10T 24/1986; Y10T 24/1966; A41D 25/022; A41D 25/02
See application file for complete search history.

(56) References Cited

U.S. PATENT DOCUMENTS

| | | | | |
|---|---|---|---|---|
| 3,526,004 | A | 9/1970 | Brandenberger | |
| 4,504,979 | A | 3/1985 | Kawamura | |
| 4,542,537 | A | 9/1985 | Plapp et al. | |
| 5,008,981 | A * | 4/1991 | Smithson | A41D 25/022 24/115 G |
| 5,216,757 | A | 6/1993 | Dorkin | |
| 5,493,731 | A * | 2/1996 | Amnott | A41D 25/022 2/148 |
| D411,575 | S | 6/1999 | LaBorde et al. | |
| 5,953,755 | A | 9/1999 | Barylski | |
| 6,094,746 | A | 8/2000 | Miller | |
| 6,691,319 | B1 | 2/2004 | Simon | |
| 7,930,806 | B2 | 4/2011 | Funk | |

* cited by examiner

*Primary Examiner* — Abigail E Troy

(57) ABSTRACT

A tie fastener for retaining a tie in a desired configuration without knotting includes a housing that defines an interior space. Each of a pair of holes is positioned through a respective opposing side of the housing. An orifice is positioned through a bottom of the housing. A coupler is coupled to the housing and is positioned in the interior space. The orifice and the holes are positioned in the housing such that each hole is configured to insert a respective end of a tie such that the tie passes through the interior space. The orifice is configured to allow the two ends of the tie to be extended from the housing. The coupler is configured to couple to the tie to retain the tie in a desired configuration without requiring the tie to be knotted.

11 Claims, 3 Drawing Sheets

TIE FASTENER

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to tie fasteners and more particularly pertains to a new tie fastener for retaining a tie in a desired configuration without knotting.

BRIEF SUMMARY OF THE INVENTION

An embodiment of the disclosure meets the needs presented above by generally comprising a housing that defines an interior space. Each of a pair of holes is positioned through a respective opposing side of the housing. An orifice is positioned through a bottom of the housing. A coupler is coupled to the housing and is positioned in the interior space. The orifice and the holes are positioned in the housing such that each hole is configured to insert a respective end of a tie such that the tie passes through the interior space. The orifice is configured to allow the two ends of the tie to be extended from the housing. The coupler is configured to couple to the tie to retain the tie in a desired configuration without requiring the tie to be knotted.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
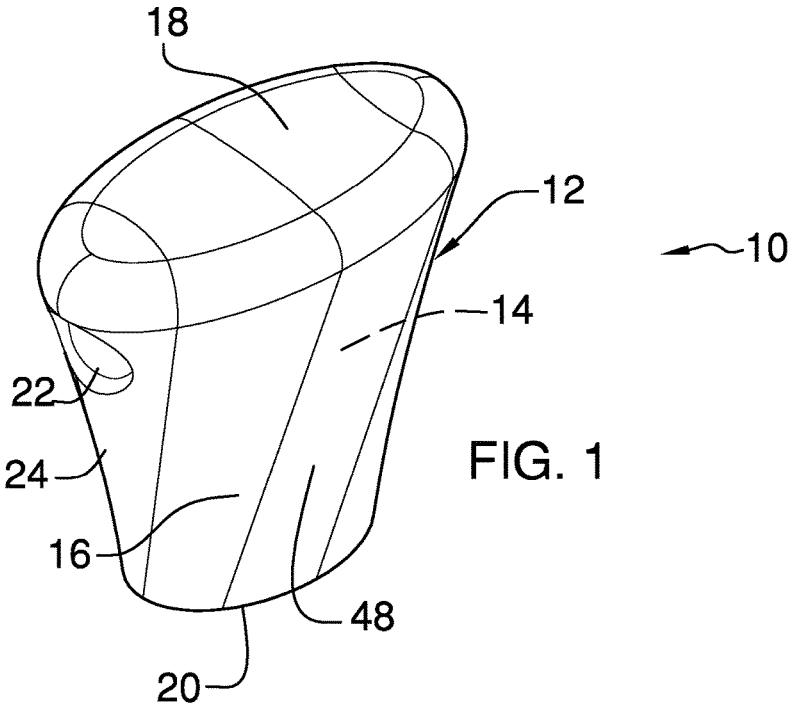
FIG. 1 is an isometric perspective view of a tie fastener according to an embodiment of the disclosure.
Figure 2:
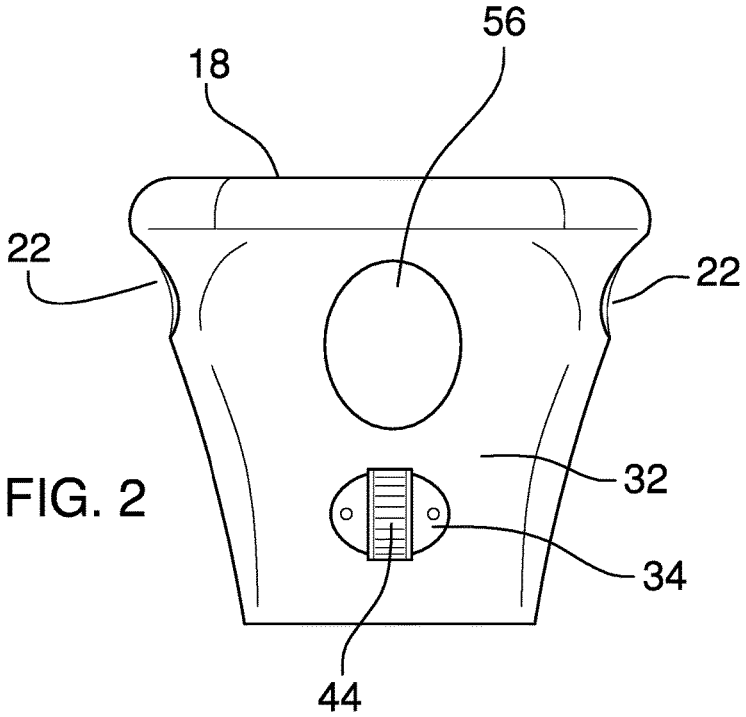
FIG. 2 is a back view of an embodiment of the disclosure.
Figure 3:
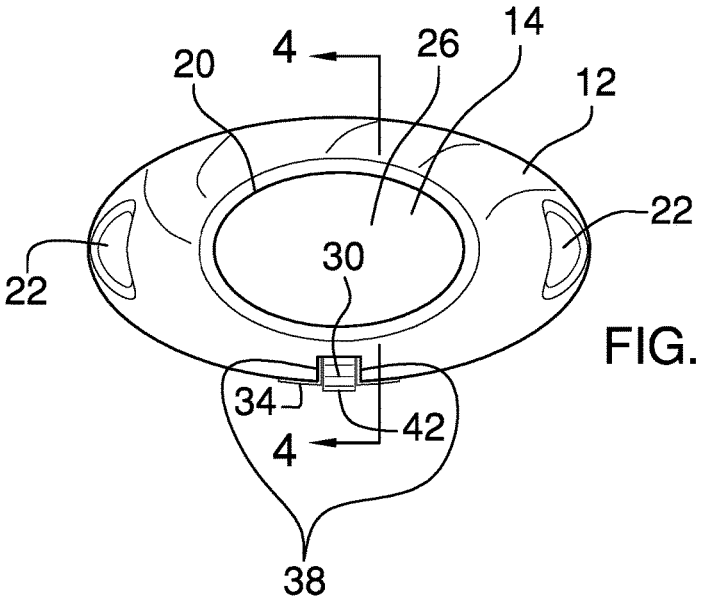
FIG. 3 is a bottom view of an embodiment of the disclosure.
Figure 4:
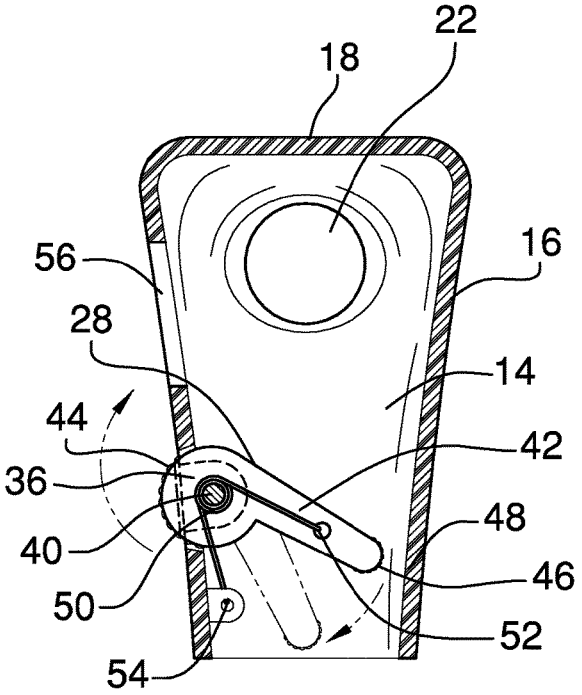
FIG. 4 is a cross-sectional view of an embodiment of the disclosure.
Figure 5:
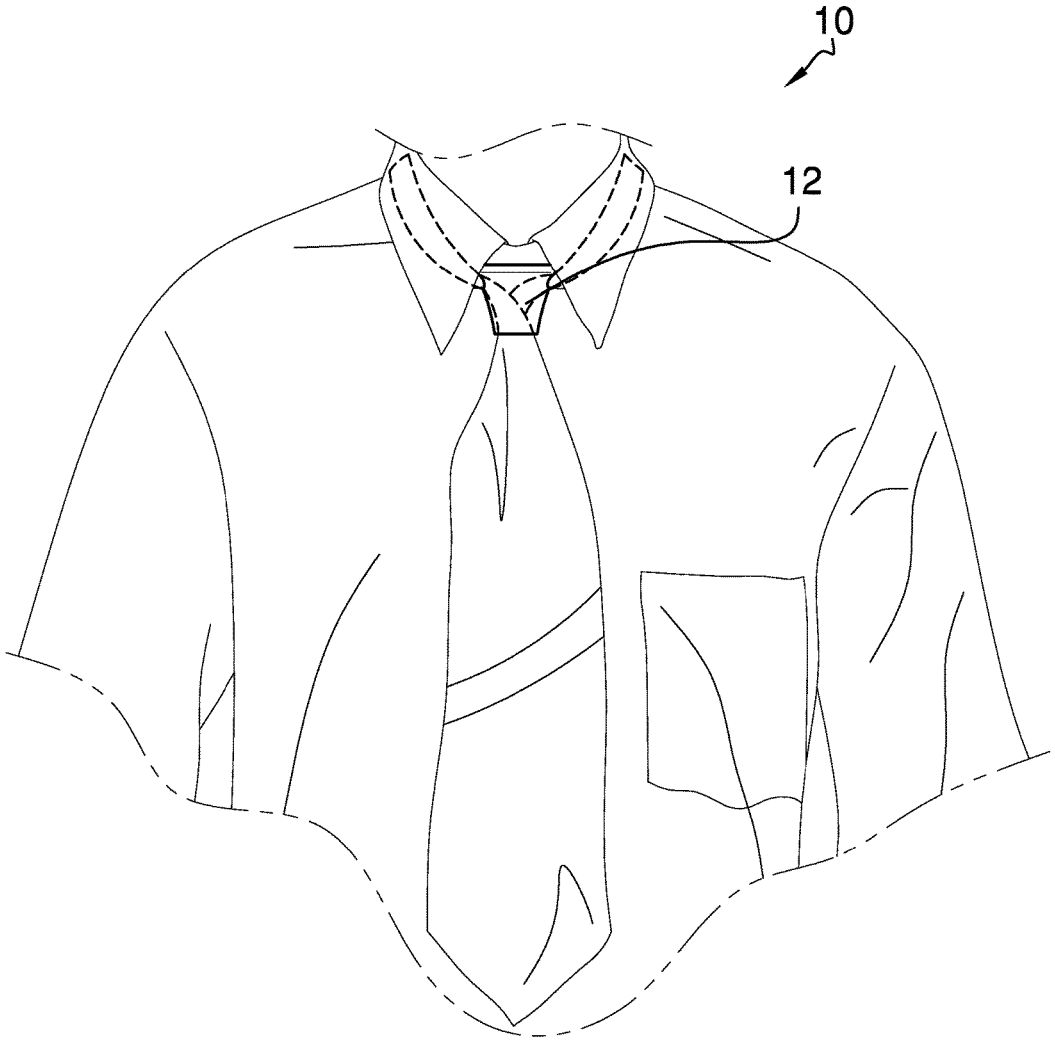
FIG. 5 is an in-use view of an embodiment of the disclosure.

With reference now to the drawings, and in particular to FIGS. 1 through 5 thereof, a new tie fastener embodying the principles and concepts of an embodiment of the disclosure and generally designated by the reference numeral 10 will be described.

As best illustrated in FIGS. 1 through 5, the tie fastener 10 generally comprises a housing 12 that defines an interior space 14. The housing 12 comprises an annular wall 16 that extends between a top 18 and a bottom 20. In one embodiment, the top 18 and the bottom 20 are substantially ovally shaped. In another embodiment, the top 18 is circumferentially larger than the bottom 20 such that the annular wall 16 is tapered and the housing 12 is substantially Windsor-knot shaped.

Each of a pair of holes 22 is positioned through a respective opposing side 24 of the housing 12. An orifice 26 is positioned through the bottom 20 of the housing 12. Each hole 22 is configured to insert a respective end of a tie so that the tie passes through the interior space 14. The orifice 26 is configured to allow the two ends of the tie to be extended from the housing 12. In one embodiment, the holes 22 are substantially circularly shaped. In another embodiment, the orifice 26 is shaped complementarily to the bottom 20.

A coupler 28 is coupled to the housing 12 and is positioned in the interior space 14. The coupler 28 is configured to selectively couple to the tie that is positioned in the interior space 14. The coupler 28 configured to couple to the tie to retain the tie in a desired configuration without requiring the tie to be knotted.

In one embodiment, the coupler 28 comprises a slot 30 that is positioned through a back 32 of the housing 12 proximate to the bottom 20 of the housing 12. A bracket 34 is coupled to the housing 12 and extends through the slot 30 into the interior space 14. The bracket 34 comprises of a pair of arms 36. Each arm 36 is positioned adjacent to a respective opposing edge 38 of the slot 30. A pin 40 is coupled to and extends between the pair of arms 36. A bar 42 is rotationally coupled to the pin 40 such that a first end 44 of the bar 42 extends through the slot 30. A second end 46 of the bar 42 is selectively rotatably positionable proximate to a front 48 of the housing 12 to couple to the tie. The tie is retained in the desired configuration without requiring the tie to be knotted.

A spring 50 is positioned around the axle. The spring 50 has a first endpoint 52 that is coupled to the bar 42 and a second endpoint 54 that is coupled to the housing 12. The second end 46 of the bar 42 is biased toward the front 48 of the housing 12. The user is positioned to rotate the bar 42 relative to the pin 40 so that the spring 50 is compressed and the second end 46 of the bar 42 is motivated distally from the front 48 of the housing 12. The tie is positionable between the front 48 of the housing 12 and the bar 42. The user is positioned to release the bar 42 so that the spring 50 is positioned to motivate the second end 46 of the bar 42 toward the front 48 of the housing 12. The bar 42 is coupled to the tie to retain the tie in the desired configuration without requiring the tie to be knotted.

In another embodiment, the first end 44 and the second end 46 of the bar 42 are arcuate. In yet another embodiment, the first end 44 is dimensionally larger than the second end 46. In still yet another embodiment, the first end 44 is textured. The first end 44 is configured to frictionally couple to a digit of the hand of the user so that the user is positioned to rotate the bar 42 relative to the pin 40. In still yet another embodiment, the second end 46 of the bar 42 is textured so that the second end 46 is configured to frictionally couple to the tie.

A penetration 56 is positioned through the back 32 of the housing 12 between the slot 30 and the top 18 of the housing 12. The penetration 56 is configured to allow insertion of a finger of the hand of the user to guide the tie through the interior space 14. In one embodiment, the penetration 56 is substantially ovally shaped.

In use, each hole 22 that is positioned in the housing 12 is configured to insert the respective end of the tie so that the tie passes through the interior space 14. The penetration 56 that is positioned in the housing 12 is configured to insert the finger of the hand of the user to guide the tie through the interior space 14. The orifice 26 that is positioned in the housing 12 is configured to allow the two ends of the tie to be extended from the housing 12. The user is positioned to rotate the bar 42 relative to the pin 40 so that the spring 50 is compressed and the second end 46 of the bar 42 is motivated distally from the front 48 of the housing 12. The tie is positionable between the front 48 of the housing 12 and the bar 42. The user is positioned to release the bar 42 so that the spring 50 is positioned to motivate the second end 46 of the bar 42 toward the front 48 of the housing 12. The bar 42 is coupled to the tie to retain the tie in the desired configuration without requiring the tie to be knotted.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A tie fastener comprising:

a housing defining an interior space;

a pair of holes, each said hole being positioned through a respective opposing side of said housing;

an orifice positioned through a bottom of said housing;

a coupler coupled to said housing and positioned in said interior space, said coupler being configured for selectively coupling to a tie positioned in said interior space, said coupler comprising a slot positioned through a back of said housing proximate to said bottom of said housing, a bracket coupled to said housing and extending through said slot into said interior space, said bracket comprising a pair of arms, each said arm being positioned adjacent to a respective opposing edge of said slot, a pin coupled to and extending between said pair of arms, a bar rotationally coupled to said pin such that a first end of said bar extends through said slot and such that a second end of said bar is selectively rotatably positionable proximate to a front of said housing for coupling to the tie for retaining the tie in the desired configuration without requiring knotting of the tie, a spring positioned around said pin, said spring having a first endpoint coupled to said bar and a second endpoint coupled to said housing such that said second end of said bar is biased toward said front of said housing, and wherein said spring is positioned on said pin such that rotation of said bar relative to said pin compresses said spring and said second end of said bar is moved away from said front of said housing such that the tie is positionable between said front of said housing and said bar, said spring biasing said second end of said bar toward said front of said housing such that said bar is configured to be engaged to the tie for retaining the tie in the desired configuration without requiring knotting of the tie; and wherein said orifice and said holes are positioned in said housing such that each said hole is configured for inserting a respective end of the tie such that the tie passes through said interior space, wherein said orifice is configured for extending the two ends of the tie from said housing, wherein said coupler is positioned on said housing such that said coupler is configured for coupling to the tie for retaining the tie in a desired configuration without requiring knotting of the tie.

2. The fastener of claim 1, wherein said housing comprises an annular wall extending between a top and a bottom, said top and said bottom being substantially ovally shaped, said top being circumferentially larger than said bottom such that said annular wall is tapered and said housing is substantially Windsor-knot shaped.

3. The fastener of claim 1, wherein said holes are substantially circularly shaped.

4. The fastener of claim 1, wherein said orifice is shaped complementarily to said bottom.

5. The fastener of claim 1, wherein said first end and said second end of said bar are arcuate.

6. The fastener of claim 5, wherein said first end is dimensionally larger than said second end.

7. The fastener of claim 1, wherein said first end is textured such that said first end is configured for frictionally coupling to a digit of the hand of the user such that the user is positioned for rotating said bar relative to said pin.

8. The fastener of claim 1, wherein said second end of said bar is textured such that said second end is configured for frictionally coupling to the tie.

9. The fastener of claim 1, further including a penetration positioned through said back of said housing between said slot and said top of said housing, wherein said penetration is positioned in said housing such that said penetration is configured for inserting a finger of the hand of the user for guiding the tie through said interior space.

10. The fastener of claim 9, wherein said penetration is substantially ovally shaped.

11. A tie fastener comprising:

a housing defining an interior space, said housing comprising an annular wall extending between a top and a bottom, said top and said bottom being substantially ovally shaped, said top being circumferentially larger than said bottom such that said annular wall is tapered and said housing is substantially Windsor-knot shaped;

a pair of holes, each said hole being positioned through a respective opposing side of said housing, said holes being substantially circularly shaped;

an orifice positioned through the bottom of said housing, wherein said orifice and said holes are positioned in said housing such that each said hole is configured for inserting a respective end of a tie such that the tie passes through said interior space, wherein said orifice is configured for extending the two ends of the tie from said housing, said orifice being shaped complementarily to said bottom;

a coupler coupled to said housing and positioned in said interior space, said coupler being configured for selectively coupling to the tie positioned in said interior space, wherein said coupler is positioned on said housing such that said coupler is configured for coupling to the tie for retaining the tie in a desired configuration without requiring knotting of the tie, said coupler comprising:

a slot positioned through a back of said housing proximate to said bottom of said housing, a bracket coupled to said housing and extending through said slot into said interior space, said bracket comprising a pair of arms, each said arm being positioned adjacent to a respective opposing edge of said slot, a pin coupled to and extending between said pair of arms, a bar rotationally coupled to said pin such that a first end of said bar extends through said slot and such that a second end of said bar is selectively rotatably positionable proximate to a front of said housing for coupling to the tie for retaining the tie in the desired configuration without requiring knotting of the tie, said first end and said second end of said bar being arcuate, said first end being dimensionally larger than said second end, said first end being textured such that said first end is configured for being frictionally engaged by a digit of a hand of a user to rotate said bar, said second end of said bar being textured such that said second end is configured for frictionally coupling to the tie, and a spring positioned around said pin, said spring having a first endpoint coupled to said bar and a second endpoint coupled to said housing such that said second end of said bar is biased toward said front of said housing, wherein said spring is positioned on said pin such that rotation of said bar relative to said pin compresses said spring and said second end of said bar is moved away from said front of said housing such that the tie is positionable between said front of said housing and said bar, said spring biasing said second end of said bar toward said front of said housing such that said bar is configured to be engaged to the tie for retaining the tie in the desired configuration without requiring knotting of the tie; and a penetration positioned through said back of said housing between said slot and said top of said housing, wherein said penetration is positioned in said housing such that said penetration is configured for inserting a finger of the hand of the user for guiding the tie through said interior space, said penetration being substantially ovally shaped.

* * * * *